US007286773B2

(12) United States Patent
Rommelmann et al.

(10) Patent No.: US 7,286,773 B2
(45) Date of Patent: Oct. 23, 2007

(54) DEVICE IDENTIFICATION METHOD AND SYSTEM

(75) Inventors: Heiko Rommelmann, Penfield, NY (US); Alberto Rodriguez, Webster, NY (US); Will Phipps, Fairport, NY (US); Scott Jonathan Bell, Rochester, NY (US); Ron Boucher, Rochester, NY (US)

(73) Assignee: Xerox Corporation, Stamford, CT (US)

( * ) Notice: Subject to any disclaimer, the term of this patent is extended or adjusted under 35 U.S.C. 154(b) by 13 days.

(21) Appl. No.: 11/013,798

(22) Filed: Dec. 17, 2004

(65) Prior Publication Data

US 2006/0133831 A1 Jun. 22, 2006

(51) Int. Cl.

| | |
|---|---|
| ***G03G 15/00*** | (2006.01) |
| ***G03G 21/16*** | (2006.01) |
| ***G03G 15/04*** | (2006.01) |

(52) U.S. Cl. ..... 399/12; 399/13; 399/111; 399/119

(58) Field of Classification Search ..... 347/19, 347/50; 399/12, 13, 24, 25, 27, 31, 111, 399/115

See application file for complete search history.

(56) References Cited

U.S. PATENT DOCUMENTS

| | | | | |
|---|---|---|---|---|
| 6,008,727 | A * | 12/1999 | Want et al. | 340/572.1 |
| 6,195,006 | B1 * | 2/2001 | Bowers et al. | 340/572.1 |
| 6,739,691 | B2 * | 5/2004 | Walker | 347/19 |
| 7,106,198 | B2 * | 9/2006 | Phipps et al. | 340/572.1 |

* cited by examiner

*Primary Examiner*—Hoang Ngo
(74) *Attorney, Agent, or Firm*—Oliff & Berridge, PLC

(57) ABSTRACT

A product identification method and associated system may include providing an identification element that corresponds to a consumable product, the identification element at least one of being portable by a user and being readable by a scanner; and at least one of marking information related to the consumable product on the identification element and storing information related to the consumable product in the identification element. Also, a product identification device may include an identification element, and information related to consumable product which is at least one of marked on the identification element and stored in the identification element.

20 Claims, 7 Drawing Sheets

DEVICE IDENTIFICATION METHOD AND SYSTEM

Co-pending application Ser. Nos. 11/012,478, 11/034,249, 11/032,248, 11/012,480, 10/978,423, 11/012,479, 11/034,058, and 11/013,703 are incorporated herein in their entirety by reference.

BACKGROUND

1. Field

The present invention relates generally to the utilization of commonly replaced system parts. The invention relates in particular to Customer Replaceable Units (CRU) and Customer Replaceable Unit Monitors (CRUM) used for their identification.

2. Description of Related Art

Many machines have replaceable sub-assemblies. Printing machines, for example, may have a number of replaceable sub-assemblies, such as a fuser print cartridge, a toner cartridge, or an automatic document handler. These subassemblies may be arranged as a unit called a cartridge, and if intended for replacement by the customer or machine owner, may be referred to as a Customer Replaceable Unit or CRU. Examples of CRUs may include a printer cartridge, a toner cartridge, or a transfer assembly unit. It may be desirable for a CRU design to vary over the course of time due to manufacturing changes or to solve post-launch problems with either the machine, the CRU, or an interaction between the CRU and the machine. Further, design optimizations may be recognized subsequent to design launch and machine sale, for example, that a relatively simple code update might realize. However, solving these problems, or providing optimization updates, generally requires a service call.

U.S. Pat. No. 4,961,088 to Gilliland et al. discloses a monitor/warranty system for electrostatographic reproducing machines in which replaceable cartridges providing a predetermined number of images are used. Each cartridge has an EEPROM programmed with a cartridge identification number that, when matched with a cartridge identification number in the machine, enables machine operation, a cartridge replacement warning count, and a termination count at which the cartridge is disabled from further use. The EEPROM stores updated counts of the remaining number of images left on the cartridge after each print run.

U.S. Pat. No. 5,272,503 to LeSueur et al. discloses a printing machine having operating parameters associated therewith. The printing machine includes a controller for controlling the operating parameters and an operator replaceable sub-assembly adapted to serve as a processing station in the printing machine. The operator replaceable sub-assembly includes a memory device, that communicates with the controller when the replaceable sub-assembly is coupled with the printing machine, for storing a value which varies as a function of the usage of the replaceable subassembly. The controller adjusts a selected one of the operating parameters in accordance with the stored value for maintaining printing quality of the printing machine.

U.S. Patent Publication No. 2003/0215247 describes a method for operating a machine using at least a first replaceable sub-assembly and at least a second replaceable subassembly. The method described comprises providing the first replaceable sub-assembly with a memory, the memory having stored within it a software code upgrade of executable instructions relating to the utilization of the second replaceable sub-assembly. The first replaceable sub-assembly is subsequently placed into the machine, the memory is used and a stored software code upgrade of executable instructions is placed into the machine as new machine software code. Then, the machine is operated with the second replaceable sub-assembly in accordance with the new machine software code.

U.S. Pat. No. 6,195,006 discloses an inventory system wherein articles, such as books, have radio frequency identification document (RFID) tags attached to them. Each tag has a unique identification or serial number for identifying the individual article. An inventory database tracks all of the tagged articles and maintains circulation status information for each article. Articles may be checked out of a library using a patron self-checkout system. Checked-out articles are returned to the library via patron self-checking devices. The shelves are periodically scanned with a mobile RFID scanner for updating inventory status.

All of the references indicated above are herein incorporated by reference in their entirety for their teachings.

As seen from these references, replaceable subassembly designs can be very dynamic over the life of the product they support. Even subtle design changes need to be tracked by the equipment manufacturer. Accordingly, different part numbers, configuration numbers, physical markings, and the like, may be assigned and/or attached to the replaceable subassembly. Sometimes even the packaging of the subassembly has to change over time. All of these changes, coupled with the ever increasing size of retail stores and the existence of different brands offered by large retail stores, can make it very difficult for a customer to find the correct replacement CRU for their application.

SUMMARY

Various implementations provide a product identification method that includes providing an identification element that corresponds to a CRU, the identification element at least one of being portable by a user and being readable by a scanner; and at least one of marking information related to the CRU on the identification element and storing information related to the CRU in the identification element.

Also, various implementations provide a product identification device that includes an identification element, and information related to a CRU which is at least one of marked on the identification element and stored in the identification element.

In addition, various implementations provide a product identification system that includes a controller, an identification element that corresponds to a consumable product, for example, of a CRU, the identification element being readable by the controller and portable by a user, and information related to the consumable product, wherein the controller is used to at least one of mark the information related to the consumable product on the identification element and store the information related to the consumable product in the identification element during manufacturing of the consumable product or of the product it is intended to support. According to various implementations, the identification element is made available to the customer with the consumable product, or with the product which the consumable is designed.

Finally, various implementations provide a product identification system that includes a controller, a reader and writer element with an interactive user interface, a smart shelf system and a database. According to various implementations, the reader and writer element can communicate with the identification element that corresponds to a consumable product and that is portable by the user, wherein the reader and writer element can communicate with the shelf system and a store database in order to retrieve information about the availability and location of the consumable product identified to which the identification element corresponds. Visual and/or audible indicators can be triggered by the smart shelf system to aid the user in locating the desired consumable product.

DETAILED DESCRIPTION

By providing reliable ways to identify particular consumable products, various problems associated with serial number updates, consistency of designation of the consumable products, or location in large storage or retail areas, can be avoided.

Figure 1:
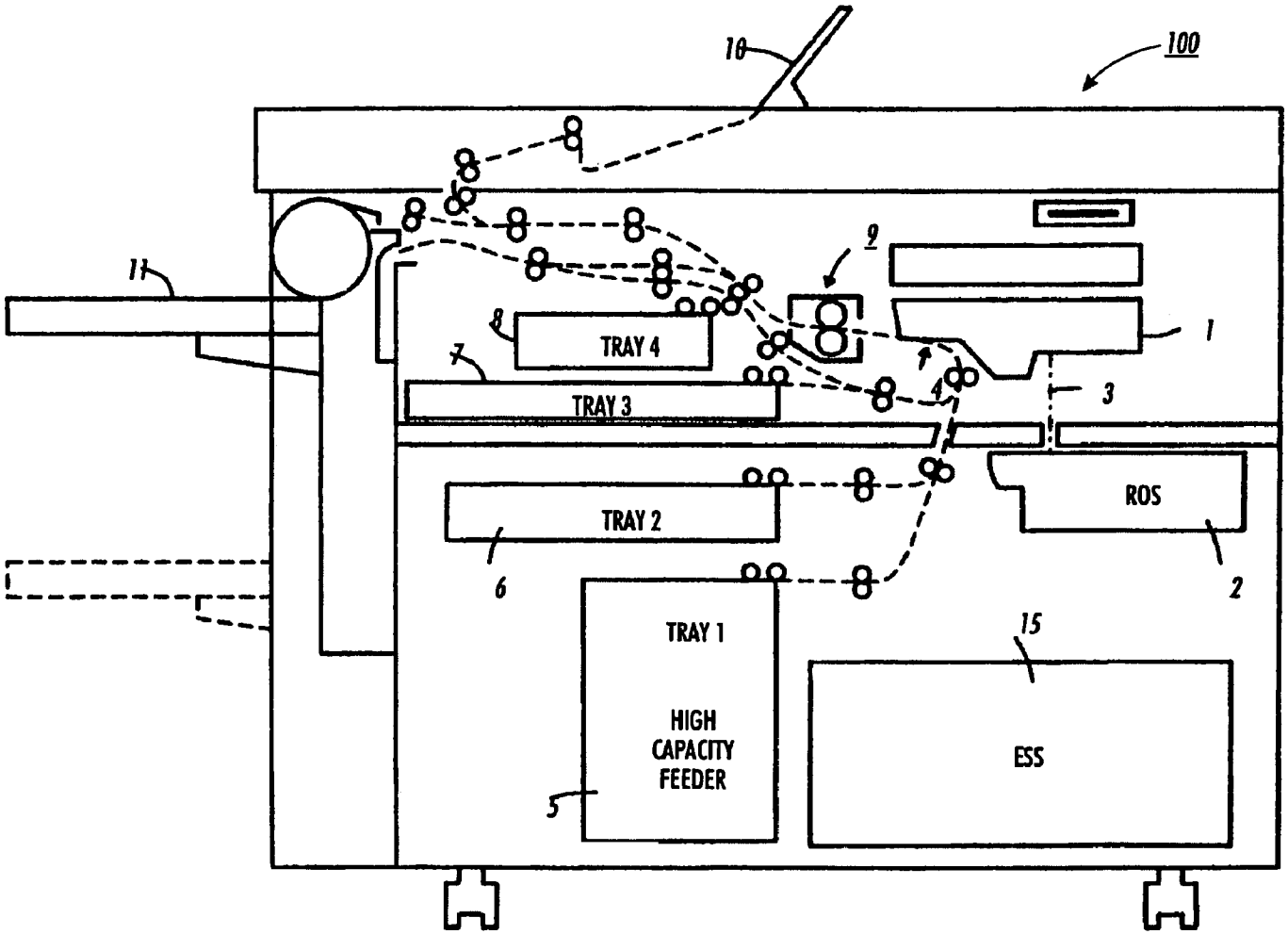
FIG. 1 depicts a schematic representation of an exemplary printing machine.

FIG. 1 depicts a schematic representation of an exemplary printing machine. FIG. 1 shows a laser printer 100 employing a consumable product in the form of a CRU 1 such as, for example, a print cartridge. As shown in FIG. 1, a xerographic imaging member in the form of an endless flexible photoreceptor belt may be housed within the CRU print cartridge 1, together with other xerographic process means, the printing machine is fully functional. The CRU print cartridge 1 may, during the lifetime of the printing machine 100, need to be replaced at regular intervals. Accordingly, various parameters identifying the CRU 1 may be stored by a user or manufacturer in, for example, a database, in order to allow the efficient replacement or upgrade of the CRU 1 when needed. As can be seen from FIG. 1, a single machine may contain other consumable products such as, for example, a fuser module 9. Although not shown, color printers can contain six or more different consumable products in the form of photoreceptor drums and toner containers for different colors, fuser modules and xerographic modules.

Figure 2:
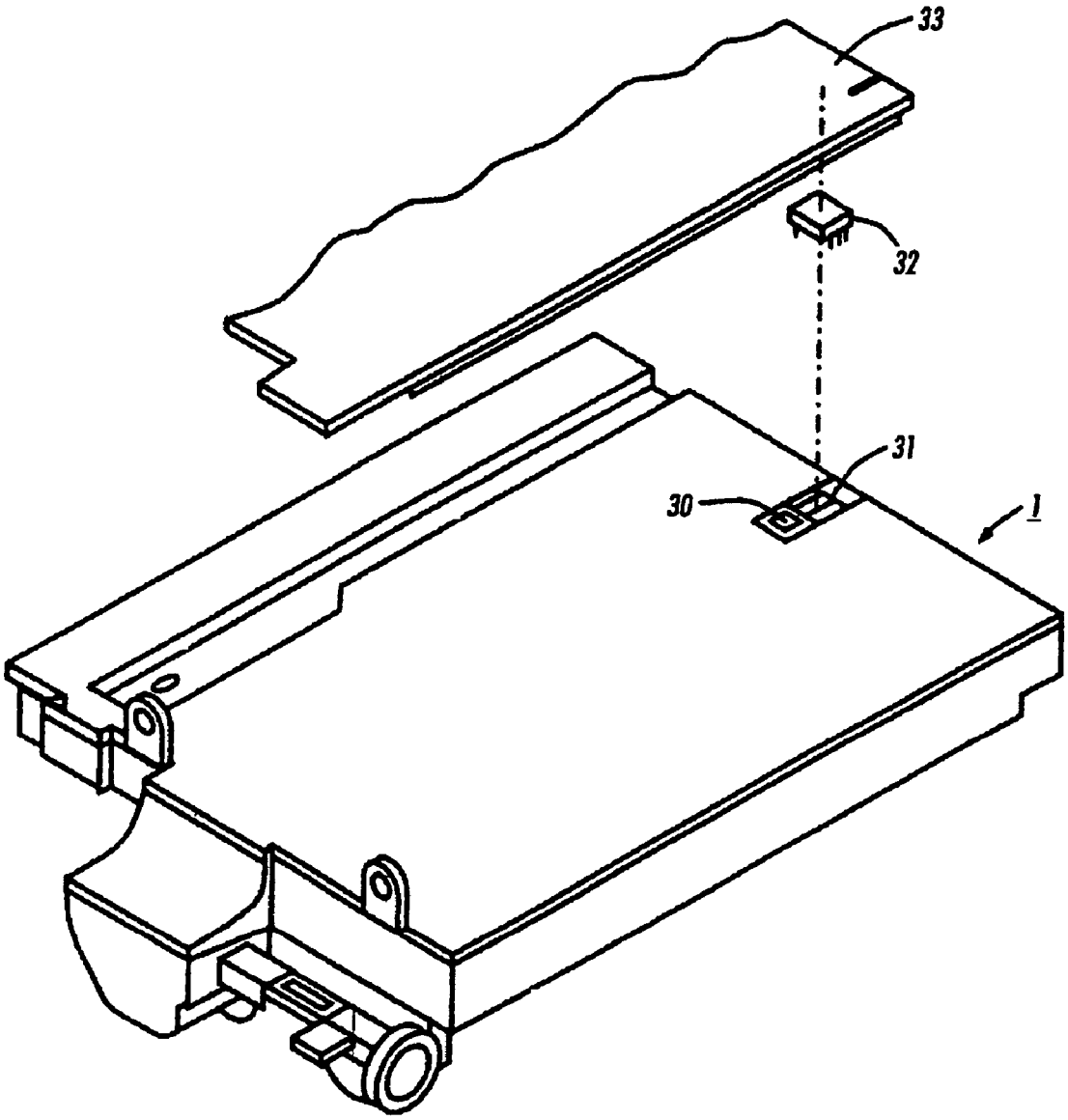
FIG. 2 is a perspective view of a CRU in which the connection of the replaceable CRU to the printing machine is shown by way of a partial view.

FIG. 2 is a perspective view of an exemplary consumable product in the form of a xerographic cartridge. In this figure, the connection of the replaceable CRU to the printing machine is shown by way of a partial view. The CRU 1, as already mentioned, is removable from the printer and may be replaced by another CRU as needed, for example if any of the process elements located therein begin to deteriorate. The print cartridge 1 has a memory chip 30, as shown in FIG. 2, in the form of a radio frequency identification tag, or RFID. The RFID may contain a memory element in the form of an EEPROM (Electrically Erasable Programmable Read Only Memory) in which parameters critical and characteristic of the CRU are stored. The details of the RFID tag and type of information stored in its memory element are discussed in detail in FIG. 4.

Figure 3:
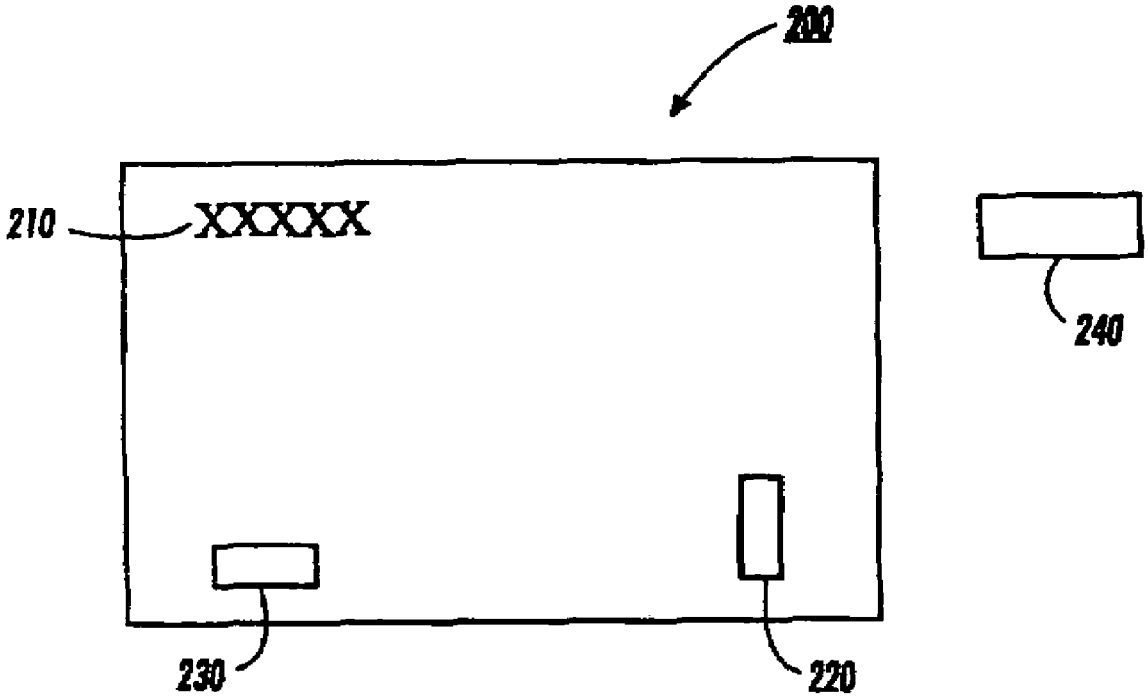
FIG. 3 is an illustration of an exemplary identification element.

FIG. 3 is an illustration of an exemplary identification element 200. In FIG. 3, the identification element 200 may include markings 210 that may represent, for example, the serial number of the CRU to which the identification element 200 corresponds and the model or type of the CRU. The identification element 200 may also include a memory element 220 in which other information related to the CRU may be stored, such as, for example, the availability of the CRU to which the identification element 200 corresponds, the location of the CRU in the store, and the model of any assembly in which the CRU may be utilized. Also, the memory element 220 may be read by a scanner or by a radio frequency identification (RFID) scanner 240. Moreover, the identification element 200 may include an RFID tag. An RFID tag and coupler system comprises a wireless entity with an antenna, and an antenna transceiver that emits a magnetic field that facilitates the communication and information exchange with the RFID scanner 240.

According to various implementations, the identification element 200 may also include a controller 230 that controls the information exchange with a scanner or the RFID scanner 240 and allows the transmission of any information stored in the memory element 220 to the RFID scanner 240. For example the identification element 200 can be shipped with either each CRU or with the product it is designed to support. When a customer needs a new CRU, the customer can take the identification element 200 to a retail store and have the identification element 200 identified by a reader. The reader may return information to the customer regarding the availability and location of the CRU in the store.

Figure 4:
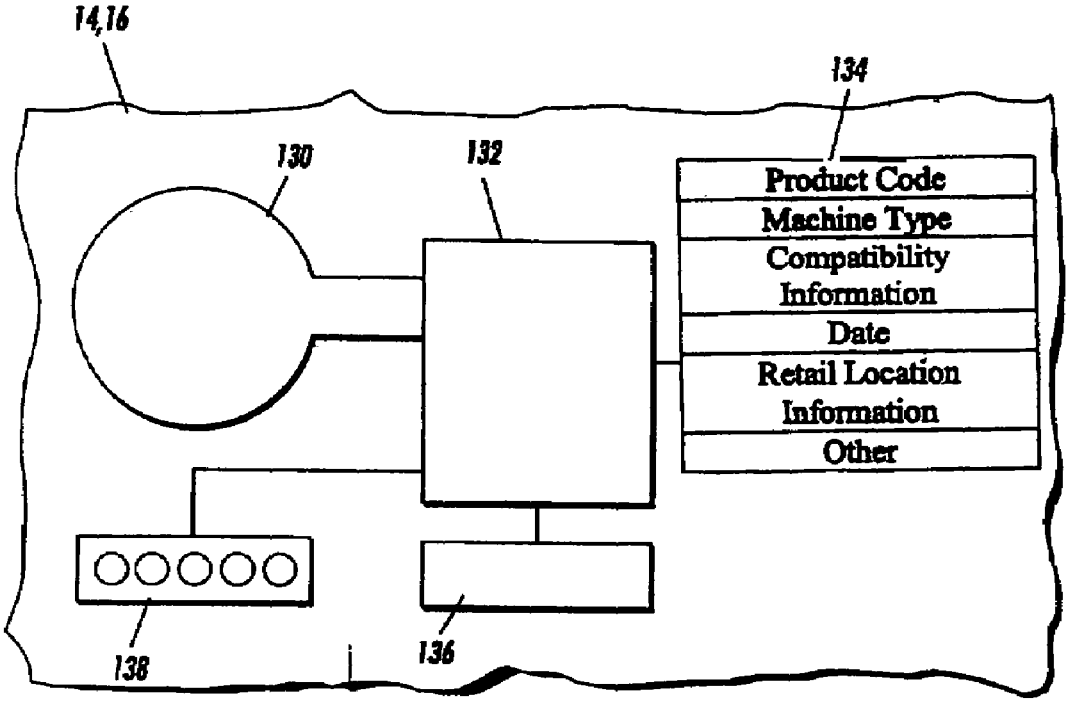
FIG. 4 is a simplified view showing elements of a CRUM operable through wireless means.

FIG. 4 is a simplified view showing elements of an exemplary CRUM operable through wireless means in the form of an RFID tag. The CRUM is preferably permanently attached to a surface either on the outside or the inside of a particular module, such as a marking material supply module 14 or marking device module 16. A portion of such a surface is shown in FIG. 4. In order to operate through wireless means, a CRUM requires some sort of wireless interface, such as an RF loop 130 (along with associated circuitry, the nature of which is well-known to those skilled in the field of RFID), although other wireless interfaces, such as an infrared detector, an ultrasound detector, or some other optical coupling, could be used.

The RF loop 130, which is sensitive to RF signals of a predetermined frequency, is associated with a chip 132. The chip 132 may include circuitry which acts as an interface between the RF loop 30 and a non-volatile memory 134. The non-volatile memory 134 may be disposed within the chip 132, but is shown separately for clarity. The loop 130 may be formed as an etched loop aerial as part of the circuit board forming the CRUM. The chip 132 may also have associated therewith a power supply 136, the exact nature of which will depend on the specific design. The chip 132 includes circuitry for recognizing and processing wireless signals of a particular type which may be detected by the loop 130. The chip 132 may further be provided with a "hard wire" interface 138, which may be adapted to interact with circuitry within the machine such as, for example, a printer.

As shown in FIG. 4, the non-volatile memory 134 includes predetermined locations therein for a product code, machine type, compatibility information, date, retail store location information, and/or any other parameter, as needed, that would help identify the CRUM in question. Accordingly, the non-volatile memory 134 may contain identification information relative to the CRUM that could be used to locate the CRUM more efficiently in, for example, a large retail store.

The wireless operation of a CRUM associated with a module may also work in different ways. The detection of a suitable wireless signal from the loop 130 by the chip 132 may cause the chip 132 to read out all data relative to the CRUM which are stored in the non-volatile memory 134 at any given time. This data from memory 134 may either be broadcast back through the loop 130 by wireless means (if such a transmission means is provided) such as within the chip 132 or alternatively, may be read out through the hard wire interface 138 to, for example, a control board. In turn, this information may be sent to a user interface and/or to a computer. As such, identification information can be broadcast to, for example, an RFID scanner, in order to store the identification information in a database or compare the identification with information already stored in a database.

Another type of wireless operation of a CRUM is to have an initially detected wireless signal causing the chip 132 to make the memory 134 enter a "write mode." In other words, the initial wireless contact, such as a wireless signal of a predetermined type that activates the chip 132, may cause the chip 132 to expect another wireless data stream through loop 130 within a predetermined time frame. This incoming data may then be used to populate specific locations in the memory 134, such as to reset different performance data parameters within the memory 134 or to upgrade identification information relative to the CRUM. More specifically, wireless means may be used to change or otherwise update other performance or identification data in the memory 134. Finally, data relating to the date of remanufacture may also be entered into the memory 134, as well as a special codes relating to what type of actions were taken on the module in the remanufacture in process, for instance, such as whether or not a photoreceptor drum was replaced or whether a particular ink tank was refilled.

In terms of enabling the above-described CRUM, basic principles of wireless controls of electromechanical and electronic devices, such as garage doors and televisions, are well known. The general principles of operating a CRUM are readily adapted from these arts in view of the present specification.

As described in the patents incorporated by reference above, it is generally known in the art that certain sophisticated security devices, such as those involving code hopping encryption, authentication, etc., provide protection or prevent unauthorized access to the CRUM and guard against counterfeiters. The chip 132 may have provided therein an encryption key which permits only those users having the encryption key to access the CRUM via wireless means. This feature is very useful for preventing unauthorized tampering with data in the memory 134, such as to alter the print counts.

Accordingly, new techniques in both remanufacturing and distributing replaceable modules, such as marking material modules and marking device modules are facilitated. One key advantage of wireless communication with a CRUM, particularly Infrared or RF communication, is that the wireless signals may pass through many types of packaging, and thus CRUMs can be operated even while the module to which they are associated is packaged.

Figure 5:
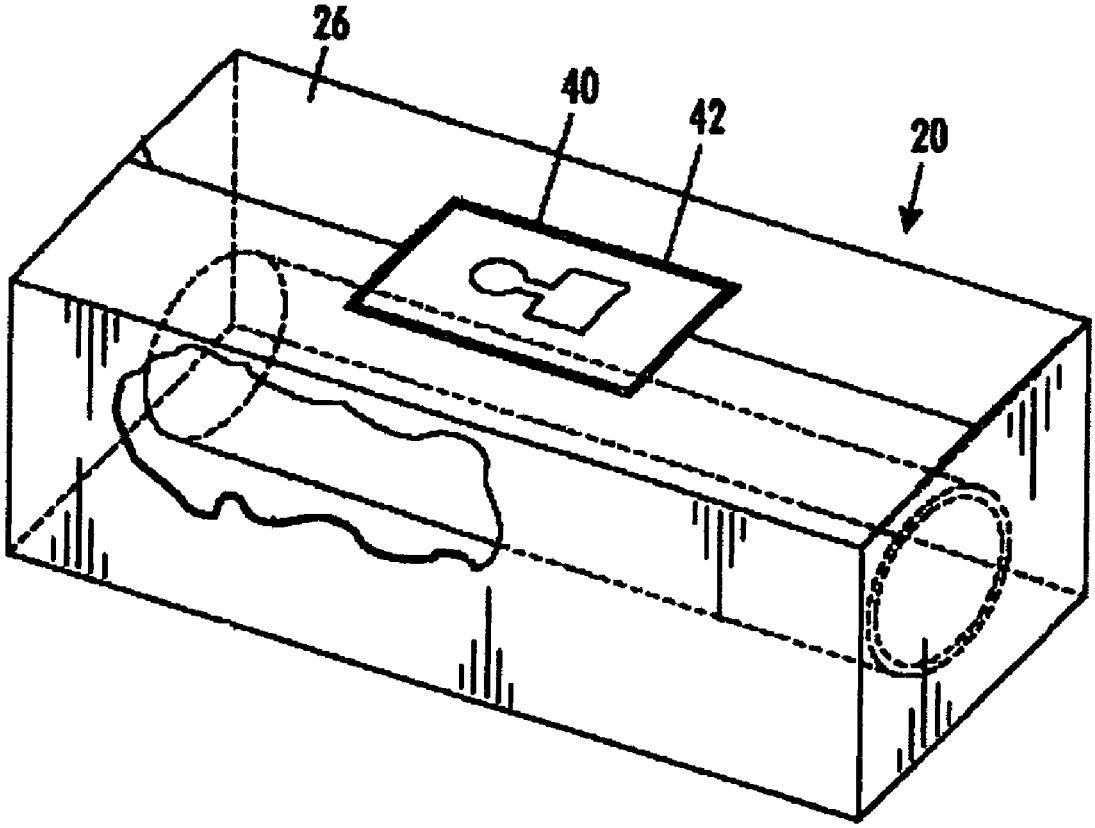
FIG. 5 illustrates an exemplary package for consumable products.

FIG. 5 illustrates an exemplary package for consumable products. In FIG. 5, a package 20 for consumable products in which an RFID tag 40, similar to the one depicted in FIG. 3, may be embedded in or applied to the package 20. The RFID tag 40 and antenna 42 are equivalent to the memory element 220 embedded in the identification element 200 of FIG. 3. In the same fashion that the memory element 220 is read by the RFID scanner 240, and all of the information stored in the memory element 220 may be transferred to the RFID scanner 240, a smart shelf system may obtain the information from the memory element attached onto the surface 26 of the package 20. The same type of information stored in the memory element 220 of FIG. 3 may be stored in the RFID tag 40 attached to the package 20.

Figure 6:
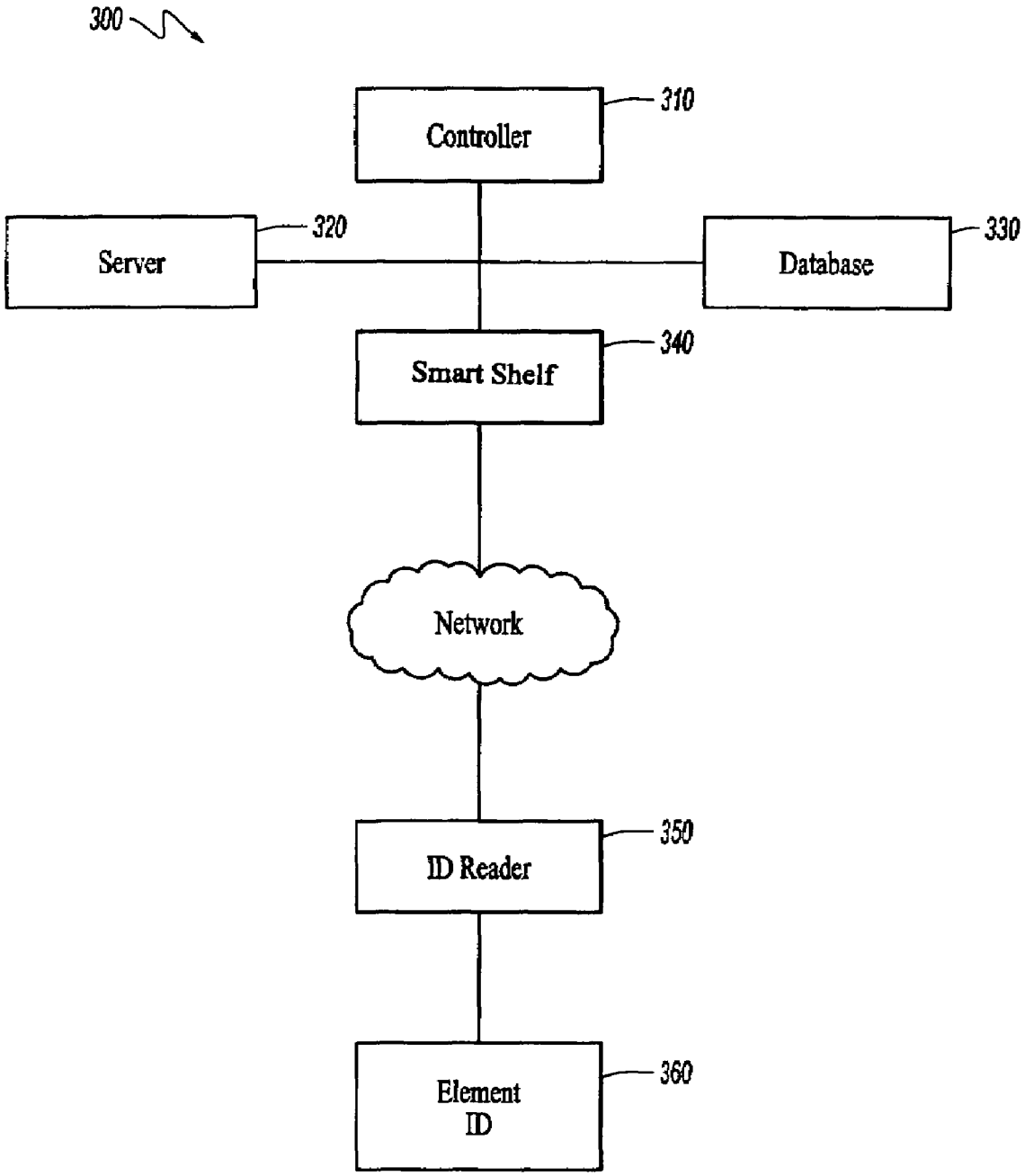
FIG. 6 is an illustration of an exemplary system for retrieving information regarding a consumable product using an identification element.
Figure 7:
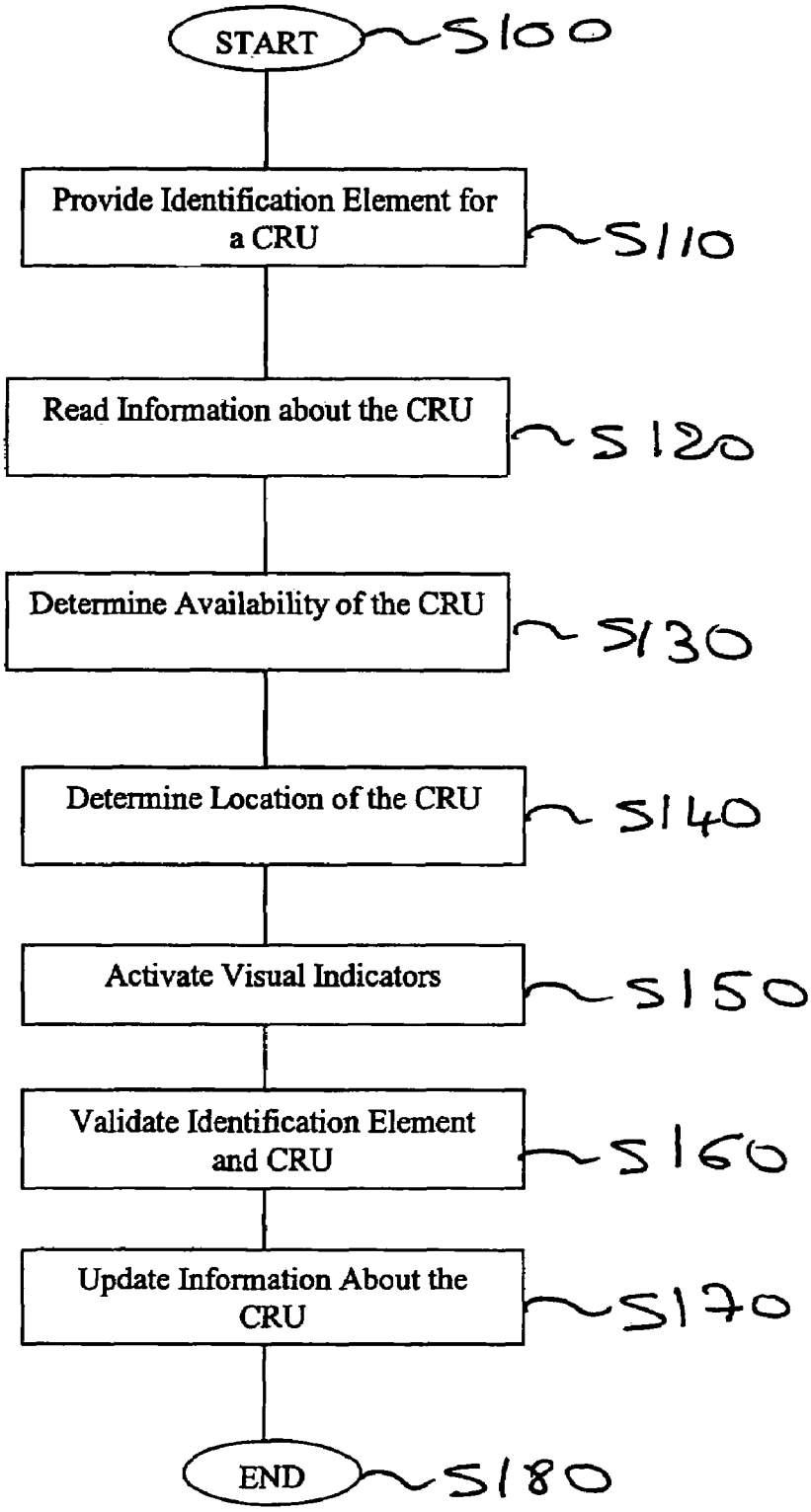
FIG. 7 is a flowchart illustrating an exemplary method of product identification.

FIG. 6 is an illustration of an exemplary system 300 for retrieving information regarding a product using an identification element. In FIG. 7, the information retrieval system 300 includes a controller 310, a server 320, a database 330, a smart shelf with visual and/or audible indicators 340, one or more ID readers 350 connected to the rest of the system 300 via a network, and an element ID 360. According to various implementations, the smart shelf 340 may trigger an audio signal or a visual signal such as, for example, a light, if a requested consumer product is located on the shelf. The database 330 may be controlled by the controller 310. The database may be functionally coupled to the server 320 in order to allow the comparison of identification information read by the identification reader 350 on the element ID 360 and transmitted over the network back to the server 320 for comparison to any consumable product information read directly from the consumable product at the smart shelf 340. The database 330 may contain product information from the manufacturer and/or information collected from various element IDs 360. Alternatively, access to the system may be controlled by a remote ID reader 350. Finally, the audio and/or visual indicators at the smart shelf 340 may allow a user to easily locate a product, and the visual and/or audio indicators may be triggered every time a request for a product location is made to the system 300.

FIG. 7 is a flowchart illustrating an exemplary method of product identification. In FIG. 7, the method starts at step S100 and continues to step S110. During step S110, an identification element is provided. According to various exemplary implementations, the identification element corresponds to a CRU. Next, control continues to step S 120. During step S120, the information marked on or stored in the identification element is read. According to various exemplary implementations, the information that is marked on the identification element is read by a user, or the information stored in a memory element of the identification element is read by a scanner. According to various exemplary implementations, the scanner may be a barcode scanner or an RFID scanner. According to various implementations, the identification element is provided to the user upon delivery of the corresponding CRU. Also, the identification element may contain information that identifies the CRU such as, for example, the location of the CRU in a store or a warehouse, the availability of the CRU, the model and serial number of the CRU and the model of the larger assembly in which the CRU is to be used.

Next, control continues to step S130, in which, for example, the availability of the CRU to which the identification element corresponds is determined after the identification element is scanned by a scanner. According to various implementations, the CRU is part of a larger assembly and may be replaced at various periods of time. As such, the availability of the CRU in a facility, as well as the availability of the larger assembly in which the CRU is used, may be determined by scanning the identification element. According to various implementations, the identification information is stored in a memory of the identification element during the manufacturing of the CRU, or during the manufacturing of the larger assembly in which the CRU is to be used. According to various implementations, the identification element includes a radio frequency identification RFID tag. According to various implementations, the identification element is read by the scanner, the information read is compared to information in the retail store database. Once a match is found the availability of the CRU is communicated to the user. Next, control continues to step S140.

During step S140, the location of the CRU to which the identification element corresponds is determined after the identification element is scanned by the scanner. The location of the CRU may be, for example, the location of the CRU in the retail store where the specific aisle and shelf where the CRU is located is provided to the user. According to various implementations, the location of the CRU is stored in the retail store database. Next, control continues to step S150. During step S150, visual and/or audible indicators present on every aisle or shelf of, for example, a retail store, may be activated. Only the visual and/or audible indicators closest to the requested CRU may be activated in order to signal to the identification element holder that the requested CRU is located next to it. Next, control continues to step S160.

During step S160, the identification element and the corresponding CRU may both be scanned back into a memory functionally coupled to the scanner in order, for example, to validate that the selected CRU is the correct match to the CRU identification information in the identification element. Next, control continues to step S170. During step S170, according to various implementations, if the information stored in the identification element is obsolete when, for example, a CRU is discontinued or upgraded, or when the numbering or inventory system of the CRU is updated, then the information stored in the identification element may also be updated with the new information available from the database or the selected CRU. According to various implementations, the RFID present on the identification element allows not only for a scanner to read the information stored in the identification element, but also allows for update information to flow from a database to the RFID. Next, control continues to step S180, where the method ends.

While the present invention is described above in connection with various implementations thereof, it will be understood that such details are exemplary and not limiting. On the contrary, various alternatives, modifications and equivalents of the details and implementations described above are contemplated. For example, any device for which having the correct consumables are essential to proper operation can benefit from the consumable card and configuration checker system. Some possible examples may be the automotive industry, where a vehicle consumable card may be packaged with all new vehicles and that contain information regarding replacement parts, recommended fluids (fuel type, oil grade, etc. . . . ), and the like. The card may also be used by the vehicle owner at an automotive store, or by a vehicle repair shop operator because service information and parts purchased can be stored on the card and shared with the automotive manufacturer. Another possible exemplary application is household appliances, where a consumable card may be packaged with the appliance and may contain information regarding replacement parts (i.e. Vacuum bag size & type), and the like.

What is claimed is:

1. A product identification method, comprising:

providing an identification element that corresponds to a consumable product, the identification element being portable by a user and being readable by a scanner;

at least one of marking information related to the consumable product on the identification element and storing information related to the consumable product in the identification element; and triggering at least one of an audio signal and a visual signal located on a smart shelf, which physically holds one or more products including the consumable product, to indicate physical proximity of the consumable product when the consumable product is determined to be physically proximate to the smart shelf, wherein the identification element is physically separate from the consumable product.

2. The product identification method of claim 1, wherein the providing an identification element that corresponds to the consumable product comprises providing the identification element to the user.

3. The product identification method of claim 1, wherein the information related to the consumable product comprises at least one of a location of the consumable product in a facility, an availability of the consumable product in the facility, a model of the consumable product, a serial number of the consumable product, and a model of an assembly in which the consumable product is usable.

4. The product identification method of claim 1, wherein the information related to the consumable product is marked on or stored in the identification element during manufacturing of the consumable product.

5. The product identification method of claim 1, further comprising reading the identification element by a scanner.

6. The product identification method of claim 5, wherein reading the identification element by a scanner comprises using a radio frequency scanner.

7. The product identification method of claim 1, further comprising updating the information related to the consumable product in the identification element.

8. The method of claim 7, wherein the updating is performed via a flow of information from a database to the identification element.

9. The method of claim 5, wherein reading the identification element by a scanner comprises using an authentication algorithm.

10. The method of claim 2, further comprising providing the consumable product corresponding to the identification element to the user.

11. The method of claim 1, wherein providing the consumable product and the identification element to the user is executed at about the same time.

12. A product identification device, comprising:

an identification element; and information related to a consumable product which is at least one of marked on the identification element and stored in the identification element;

wherein the identification element is physically separate from the consumable product, and the identification element causes a smart shelf, which physically holds one or more products including the consumable product, to trigger at least one of an audio signal and a visual signal located on the smart shelf to indicate physical proximity of the consumable product when the consumable product is determined to be physically proximate to the smart shelf.

13. The product identification device of claim 12, wherein the identification element comprises a card.

14. The product identification device of claim 12, wherein the identification element comprises an RFID device.

15. The product identification device of claim 12, wherein the identification element comprises a memory.

16. A product identification system, comprising:

a controller;

an identification element that corresponds to a consumable product, the identification element being readable by the controller and portable by a user;

information related to the consumable product; and a smart shelf having at least one of an audio signal and a visual signal, wherein the smart shelf physically holds one or more products including the consumable product, and when the consumable product is determined to be physically proximate to the smart shelf, the at least one of the audio and visual signals is triggered to indicate physical proximity of the consumable product, wherein the controller is used to at least one of mark the information related to the consumable product on the identification element and store the information related to the consumable product in the identification element; and the identification element is physically separate from the consumable product.

17. The system of claim 16, wherein a smart shelf that comprises at least one of an audio signal or a visual signal is triggered by the controller when the consumable product is located on the smart shelf.

18. The method of claim 5, wherein the scanner reads information contained in the identification element and stores the information in a database.

19. The method of claim 18, wherein the database is coupled to a retail store.

20. The method of claim 19, further comprising activating at least one of an audio or a visual signal on a smart shelf located in the retail store and that is functionally coupled to the database when the consumable product is located on the smart shelf.

* * * * *